US008599223B2

(12) United States Patent
Hasegawa et al.

(10) Patent No.: US 8,599,223 B2
(45) Date of Patent: Dec. 3, 2013

(54) DISPLAY DEVICE, METHOD FOR CORRECTING LUMINANCE DEGRADATION, AND ELECTRONIC APPARATUS

(75) Inventors: Hiroshi Hasegawa, Kanagawa (JP); Kazuo Nakamura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 493 days.

(21) Appl. No.: 12/801,648

(22) Filed: Jun. 18, 2010

(65) Prior Publication Data

US 2011/0037786 A1 Feb. 17, 2011

(30) Foreign Application Priority Data

Aug. 12, 2009 (JP) ..... 2009-187004

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS

| | | | | |
|---|---|---|---|---|
| 2004/0070558 | A1* | 4/2004 | Cok et al. | 345/76 |
| 2007/0206869 | A1* | 9/2007 | Yokoi | 382/232 |
| 2007/0236431 | A1 | 10/2007 | Tada et al. | |
| 2008/0122819 | A1* | 5/2008 | Cho et al. | 345/205 |
| 2009/0231575 | A1* | 9/2009 | Saito et al. | 356/218 |
| 2010/0020107 | A1* | 1/2010 | Chui | 345/690 |

FOREIGN PATENT DOCUMENTS

JP 2007-240804 9/2007

* cited by examiner

*Primary Examiner* — Chanh Nguyen
*Assistant Examiner* — Tsegaye Seyoum
(74) *Attorney, Agent, or Firm* — Rader, Fishman & Grauer PLLC

(57) ABSTRACT

A display device includes a first reference pixel section configured to be driven to emit light at a predetermined luminance, a second reference pixel section configured to be driven to emit light when an amount of luminance degradation is to be detected, and a correcting unit configured to correct luminance degradation of effective pixels that contribute to display on the basis of a detection result of luminances of the first reference pixel section and the second reference pixel section.

19 Claims, 16 Drawing Sheets

DISPLAY DEVICE, METHOD FOR CORRECTING LUMINANCE DEGRADATION, AND ELECTRONIC APPARATUS

BACKGROUND OF THE INVENTION

1. Field of the Invention

The present invention relates to a display device, a method for correcting luminance degradation, and an electronic apparatus.

2. Description of the Related Art

In recent years, in the field of display devices for displaying images, flat (flat-panel) light-emitting display devices have rapidly become widespread in which pixels including light-emitting elements serving as electro-optical elements are arranged in a matrix. An example of available light-emitting elements includes organic electroluminescence (EL) elements that utilize a phenomenon of emitting light when an electric field is applied to an organic thin film. The organic EL elements are so-called current-driven electro-optical elements, the light-emission luminance of which changes in accordance with the values of currents flowing through the elements.

An organic EL display device including organic EL elements serving as electro-optical elements has the following features. That is, the organic EL elements can be driven with an applied voltage of 10 V or less and thus the power consumption is low. Since the organic EL elements are light-emitting elements, the organic EL display device has a high image visibility compared to a liquid crystal display device that displays an image by controlling light intensity from a light source in units of pixels in liquid crystal. Also, a lighting unit such as a backlight is unnecessary, and thus the weight and thickness of the device can be easily reduced. Furthermore, the response speed of the organic EL elements is very high at about several μsec, which prevents the occurrence of an afterimage when a moving image is displayed.

Meanwhile, in light-emitting elements, as represented by organic EL elements, the luminance efficiency decreases in proportion to the amount of emitted light and the light emission period. Therefore, in a light-emitting display device, dummy pixels that do not contribute to display are provided as reference pixels on a display panel (substrate) on which effective pixels that contribute to display are provided, and the amount of luminance degradation of the effective pixels is estimated on the basis of the amount of luminance degradation of the reference pixels. Then, the amount of luminance degradation of the reference pixels is detected (measured), and the luminance degradation of the effective pixels is corrected on the basis of the detection result (e.g., see Japanese Unexamined Patent Application Publication No. 2007-240804).

SUMMARY OF THE INVENTION

In the case of correcting the luminance degradation of the effective pixels on the basis of the amount of luminance degradation of the reference pixels as in the related art described in Japanese Unexamined Patent Application Publication No. 2007-240804, it is necessary to correctly detect (measure) the amount of luminance degradation of the reference pixels. However, in general, a detection result is greatly affected by environmental conditions, such as the temperature and brightness of the environment where the amount of luminance degradation of the reference pixels is detected, and thus it is very difficult to detect the correct amount of degradation.

In order to correctly detect the amount of luminance degradation of the reference pixels, it is necessary to regularly observe an output level corresponding to a certain input and compare the output level with an initial value. Here, factors responsible for inhibition of accurate detection of the amount of degradation include variations in characteristics of a luminance measuring device for measuring the light-emission luminance of the reference pixels and the measurement environment.

The luminance measuring device is large and expensive, and is thus inappropriate for regularly measuring the amount of luminance degradation of the reference pixels in a display device. For this reason, a luminance sensor including a photodiode or the like is generally used to detect the amount of luminance degradation of the reference pixels. Characteristics of this luminance sensor vary similarly to a diode, and thus it is difficult to detect the amount of luminance degradation of the reference pixels as an accurate absolute value. Furthermore, the luminance sensor includes a photodiode and therefore has distinctive temperature characteristics, and thus a detection value significantly varies depending on the conditions of environment where the display device is placed.

Accordingly, it is desirable to provide a display device capable of detecting the amount of luminance degradation of effective pixels without being affected by conditions of environment where the display device is placed, a method for correcting luminance degradation in the display device, and an electronic apparatus including the display device.

According to an embodiment of the present invention, by using a first reference pixel section configured to be driven to emit light at a predetermined luminance and a second reference pixel section configured to be driven to emit light when an amount of luminance degradation is to be detected, luminance degradation of effective pixels that contribute to display is corrected on the basis of a detection result of luminances of the first reference pixel section and the second reference pixel section in order to correct luminance degradation of a display device.

The first reference pixel section is driven to emit light at the predetermined luminance, and the luminance of the first reference pixel section is detected, so that a detection result of the luminance of the first reference pixel section in which luminance degradation progresses can be obtained in accordance with a condition of environment where the display device is placed. On the basis of the detection result obtained after luminance degradation has occurred, the amount of luminance degradation of effective pixels in which luminance degradation progresses can be estimated in accordance with the condition of environment where the display device is placed. On the other hand, the second reference pixel section is driven to emit light and the luminance of the second reference pixel section is detected to detect the amount of luminance degradation, so that a detection result of the luminance of the second reference pixel section in an initial state where luminance degradation has not occurred can be obtained in accordance with the condition of environment where the display device is placed. On the basis of the detection result of the initial luminance state, the luminance in the initial state of the effective pixels based on the condition of environment where the display device is placed can be estimated.

That is, both the detection result of the luminance of the first reference pixel section and the detection result of the luminance of the second reference pixel section are detection results based on the condition of environment where the display device is placed. On the basis of those detection results of the luminances of the first and second reference pixel sections, the amount of luminance degradation of effective pixels from the initial state can be obtained with an influence of the condition of environment where the display device is placed being eliminated. Also, by controlling the luminance of the effective pixels on the basis of the amount of luminance degradation obtained from the detection results of the luminances of the first and second reference pixels sections, the luminance degradation of the effective pixels from the initial state can be corrected.

According to an embodiment of the present invention, the detection results of the luminances of the first and second reference pixel sections are detection results based on the condition of environment where the display device is placed, and thus the amount of luminance degradation of effective pixels can be detected without being affected by the condition of environment.

BRIEF DESCRIPTION OF THE DRAWINGS

FIGS. 22A to 22G illustrate appearances of a mobile phone to which an embodiment of the present invention is applied, in which FIG. 22A is a front view illustrating an open state, FIG. 22B is a side view thereof, FIG. 22C is a front view illustrating a closed state, FIG. 22D is a left side view, FIG. 22E is a right side view, FIG. 22F is a top view, and FIG. 22G is a bottom view.

DESCRIPTION OF THE PREFERRED EMBODIMENTS

Hereinafter, embodiments of the present invention will be described in detail with reference to the drawings. The description will be given in the following order.

1. Display Device to Which an Embodiment of the Present Invention is Applied (Example of Organic EL Display Device)
   - 1-1. System Configuration
   - 1-2. Pixel Circuit
2. First Embodiment (Example in Which Reference Pixel Section and Degradation Measurement Pixel Section are Arranged Horizontally)
   - 2-1. Configuration of Reference Pixel Section
   - 2-2. Configuration of Luminance Sensor
   - 2-3. Luminance Degradation Correcting Unit
   - 2-4. Method for Measuring the Amount of Luminance Degradation
   - 2-5. Operation and Effect of First Embodiment
3. Second Embodiment (Example in Which Degradation Measurement Pixel Sections are Arranged Vertically, Horizontally, and Diagonally with a Reference Pixel Section Being the Center)
   - 3-1. Configuration of Reference Pixel Section
   - 3-2. Configuration of Luminance Sensor
   - 3-3. Operation and Effect of Second Embodiment
4. Modification
5. Applications (Electronic Apparatus)

1. Display Device to Which an Embodiment of the Present Invention is Applied

1-1. System Configuration

Figure 1:
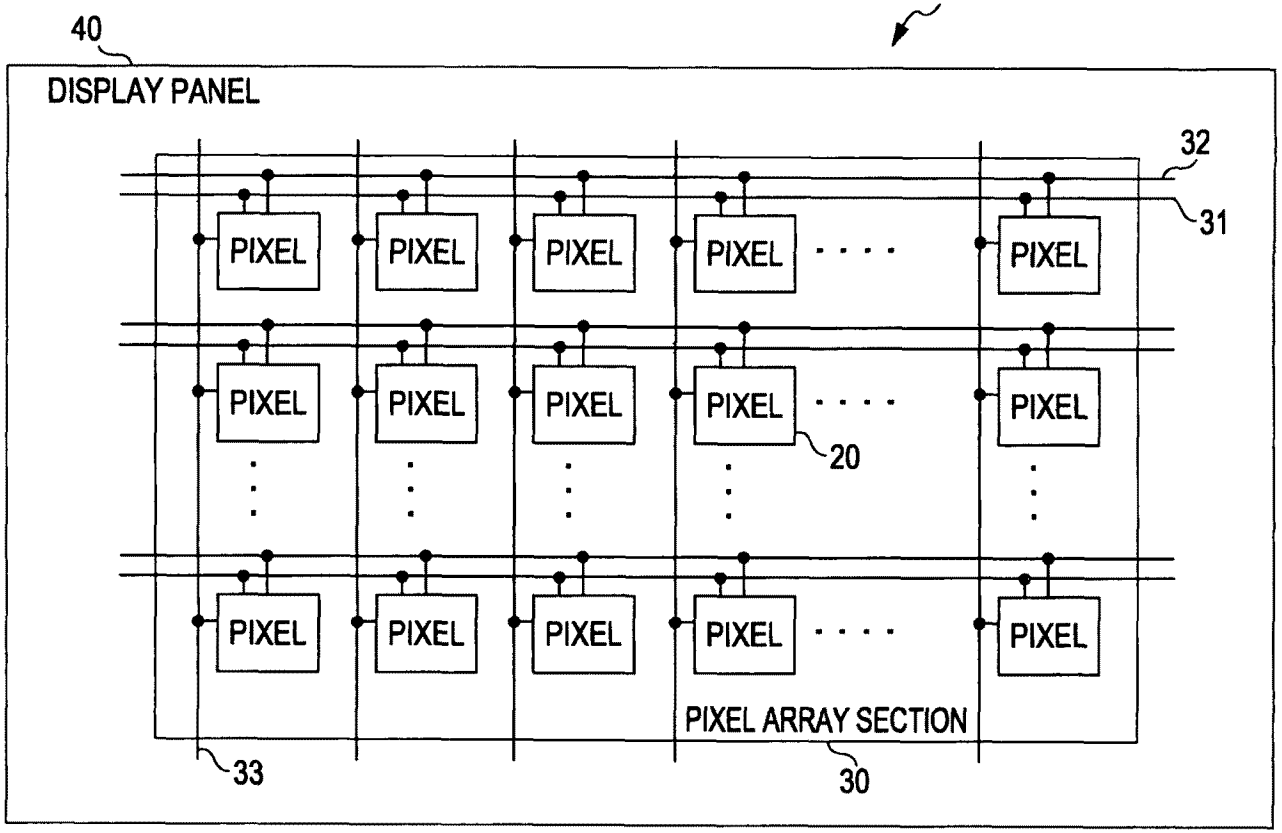
FIG. 1 is a system configuration diagram illustrating an overview of a configuration of an organic EL display device to which an embodiment of the present invention is applied.

FIG. 1 is a system configuration diagram illustrating an overview of a configuration of an active-matrix display device to which an embodiment of the present invention is applied. Here, as an example, a description will be given about an active-matrix organic EL display device that includes current-driven electro-optical elements in which light-emission luminance changes in accordance with the values of currents flowing through the elements, for example, organic EL elements, which are used as light-emitting elements of pixels (pixel circuits).

As illustrated in FIG. 1, an organic EL display device 10 according to this embodiment includes a pixel array section 30 in which a plurality of pixels 20, each including an organic EL element serving as a light-emitting element, are two-dimensionally arranged in a matrix, and a drive unit that drives each of the pixels 20 in the pixel array section 30. Although not illustrated in the figure, the drive unit includes a write scanning unit, a power supply unit, and a signal supply unit.

Here, when the organic EL display device 10 is compatible with color display, each pixel includes a plurality of sub-pixels, which correspond to one pixel 20. More specifically, in a color display device, each pixel includes three sub-pixels: a sub-pixel that emits red (R) light; a sub-pixel that emits green (G) light; and a sub-pixel that emits blue (B) light.

Note that the configuration of one pixel is not limited to a combination of sub-pixels of the three primary colors RGB. Alternatively, one pixel may include a sub-pixel of one color or a plurality of sub-pixels of a plurality of colors in addition to the sub-pixels of the three primary colors. More specifically, for example, one pixel may include a sub-pixel that emits white (W) light for increasing luminance, or one pixel may include at least one sub-pixel that emits complementary-color light for enlarging a color reproduction range.

In the pixel array section 30, write scanning lines 31 and power supply lines 32 are arranged for respective pixel rows along a row direction (the direction in which pixels in the pixel rows are arranged) with respect to the arrangement of the pixels 20 in a matrix. Furthermore, signal lines 33 are arranged for respective pixel columns along a column direction (the direction in which pixels in the pixel columns are arranged).

In an ordinary case, the pixel array section 30 is formed on a transparent insulating substrate, such as a glass substrate. Accordingly, the organic EL display device 10 has a flat panel structure. A drive circuit that drives the organic EL elements of the pixels 20 can be formed by using an amorphous silicon thin film transistor (TFT) or a low-temperature polysilicon TFT. In the case of using a low-temperature polysilicon TFT, the drive unit including the write scanning unit, the power supply unit, and the signal supply unit can be mounted on a display panel (substrate) 40 in which the pixel array section 30 is formed.

1-2. Pixel Circuit

Figure 2:
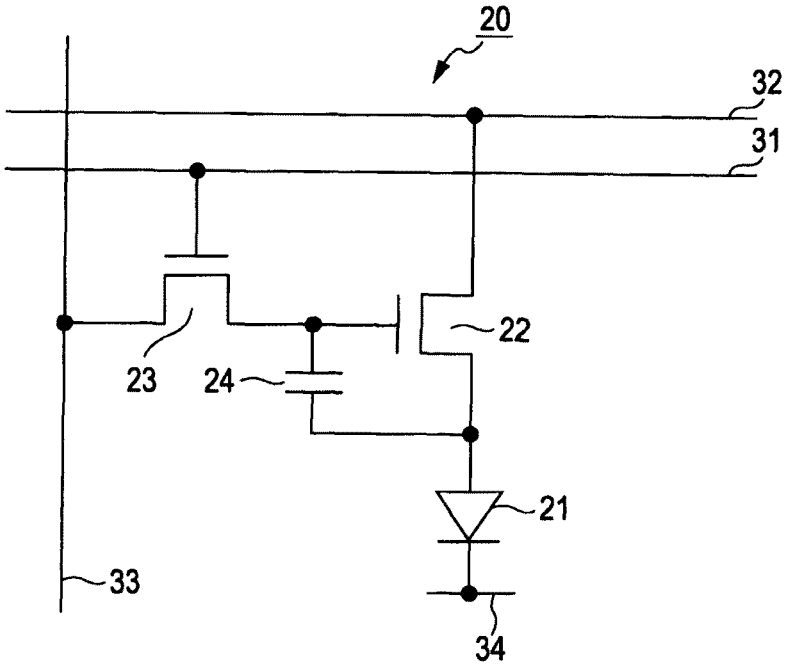
FIG. 2 is a circuit diagram illustrating a circuit configuration of a pixel (pixel circuit) of the organic EL display device to which an embodiment of the present invention is applied.

FIG. 2 is a circuit diagram illustrating an example of a specific circuit configuration of one pixel (pixel circuit) 20.

As illustrated in FIG. 2, the pixel 20 includes a light-emitting element, e.g., an organic EL element 21 serving as a current-driven electro-optical element in which light-emission luminance changes in accordance with the values of currents flowing through the element, and a drive circuit that drives the organic EL element 21. The organic EL element 21 is has a cathode electrode connected to a common power supply line 34 that is wired to all the pixels 20 in common (so-called common wiring).

The drive circuit that drives the organic EL element 21 includes a drive transistor 22, a write transistor 23, and a storage capacitor 24. Here, N-channel TFTs are used as the drive transistor 22 and the write transistor 23. However, this combination of conductivity types of the drive transistor 22 and the write transistor 23 is merely an example, and another combination may also be employed.

When N-channel TFTs are used as the drive transistor 22 and the write transistor 23, an amorphous silicon (a-Si) process can be used. With the use of the a-Si process, the cost of a substrate in which TFTs are formed can be reduced, whereby the cost of the organic EL display device 10 can be reduced. In addition, when the drive transistor 22 and the write transistor 23 are of the same conductivity type, both the transistors 22 and 23 can be formed in the same process, which reduces the cost.

One electrode (source/drain electrode) of the drive transistor 22 is connected to the anode electrode of the organic EL element 21, and the other electrode (drain/source electrode) of the drive transistor 22 is connected to the power supply line 32.

Here, a first power supply potential or a second power supply potential that is lower than the first power supply potential is selectively supplied from a power supply unit (not illustrated) to the power supply line 32. In the pixel circuit according to this embodiment, light emission/light non-emission of the pixel 20 is controlled by switching the power supply potential of the power supply line 32.

One electrode (source/drain electrode) of the write transistor 23 is connected to the signal line 33, and the other electrode (drain/source electrode) of the write transistor 23 is connected to the gate electrode of the drive transistor 22. The gate electrode of the write transistor 23 is connected to the write scanning line 31.

In the drive transistor 22 and the write transistor 23, one electrode is a metal wire that is electrically connected to a source/drain region, and the other electrode is a metal wire that is electrically connected to a drain/source region. Also, depending on the potential relationship between one electrode and the other electrode, the one electrode may serve as a source electrode or a drain electrode, and the other electrode may serve as a drain electrode or a source electrode.

One electrode of the storage capacitor 24 is connected to the gate electrode of the drive transistor 22, and the other electrode of the storage capacitor 24 is connected to the other electrode of the drive transistor 22 and the anode electrode of the organic EL element 21.

In the pixel 20 having the above-described configuration, the write transistor 23 enters a conductive state in response to a high-active write scanning signal that is applied from a write scanning unit (not illustrated) through the write scanning line 31 to the gate electrode. Accordingly, the write transistor 23 samples a signal voltage Vsig of a video signal corresponding to luminance information supplied through the signal line 33 from a signal output circuit 60 and writes the sampled signal voltage Vsig in the pixel 20. The written signal voltage Vsig is applied to the gate electrode of the drive transistor 22 and is stored in the storage capacitor 24.

When the power supply potential of the power supply line 32 is the first power supply potential, the drive transistor 22 operates in a saturation region with one electrode thereof serving as a drain electrode and the other electrode thereof serving as a source electrode. Accordingly, the drive transistor 22 receives a current supplied from the power supply line 32 and drives the organic EL element 21 to emit light by using the current. More specifically, the drive transistor 22 operates in a saturation region, thereby supplying, to the organic EL element 21, a drive current having a current value corresponding to the voltage value of the signal voltage Vsig stored in the storage capacitor 24. Accordingly, the drive transistor 22 drives the organic EL element 21 by using the current so as to cause the organic EL element 21 to emit light.

Furthermore, when the power supply potential of the power supply line 32 is switched from the first power supply potential to the second power supply potential, the drive transistor 22 operates as a switching transistor with one electrode thereof serving as a source electrode and the other electrode thereof serving as a drain electrode. Accordingly, the drive transistor 22 stops supplying a drive current to the organic EL element 21 and causes the organic EL element 21 to enter a light non-emission state. That is, the drive transistor 22 also functions as a transistor that controls the organic EL element 21 to emit light or not to emit light.

With the switching operation of the drive transistor 22, a period during which the organic EL element 21 is in a light non-emission state (a light non-emission period) is provided, and the ratio (duty ratio) of the light emission period to the light non-emission period of the organic EL element 21 can be controlled. With the control of the duty ratio, afterimage blur caused by light emission of pixels during a one-frame period can be reduced. Therefore, particularly the quality of a moving image can further be improved.

The above-described circuit configuration of the pixel circuit is merely an example. That is, the configuration of the drive circuit for the organic EL element 21 is not limited to the circuit configuration including two transistor elements: the drive transistor 22 and the write transistor 23, and one capacitor element: the storage capacitor 24.

As another example of the circuit configuration, an auxiliary capacitor that has one electrode connected to the anode electrode of the organic EL element 21 and the other electrode connected to a fixed potential so as to compensate for lack of capacitance of the organic EL element 21 may be provided as necessary. Furthermore, the following circuit configuration may also be employed. That is, a switching transistor is connected in series to the drive transistor 22, and light emission/light non-emission of the organic EL element 21 is controlled by conduction/non-conduction of the switching transistor.

In a light-emitting display device represented by the organic EL display device 10 having the above-described configuration, dummy pixels that do not contribute to display are provided as reference pixels on the display panel 40, and the amount of luminance degradation of the pixels 20 is estimated on the basis of the amount of luminance degradation of the reference pixels, as described above. Here, the pixels 20 in the pixel array section 30 are pixels that contribute to display (hereinafter those pixels may be referred to as effective pixels 20). The amount of luminance degradation of the reference pixels is detected (measured), and the luminance degradation of the effective pixels 20 is corrected on the basis of the detection result. An embodiment of the present invention is characterized by the configuration of a luminance degradation correcting circuit, particularly the configuration of the portion of the reference pixels. Hereinafter, specific embodiments of the configuration will be described.

2. First Embodiment

2-1. Configuration of Reference Pixel Section

Figure 3:
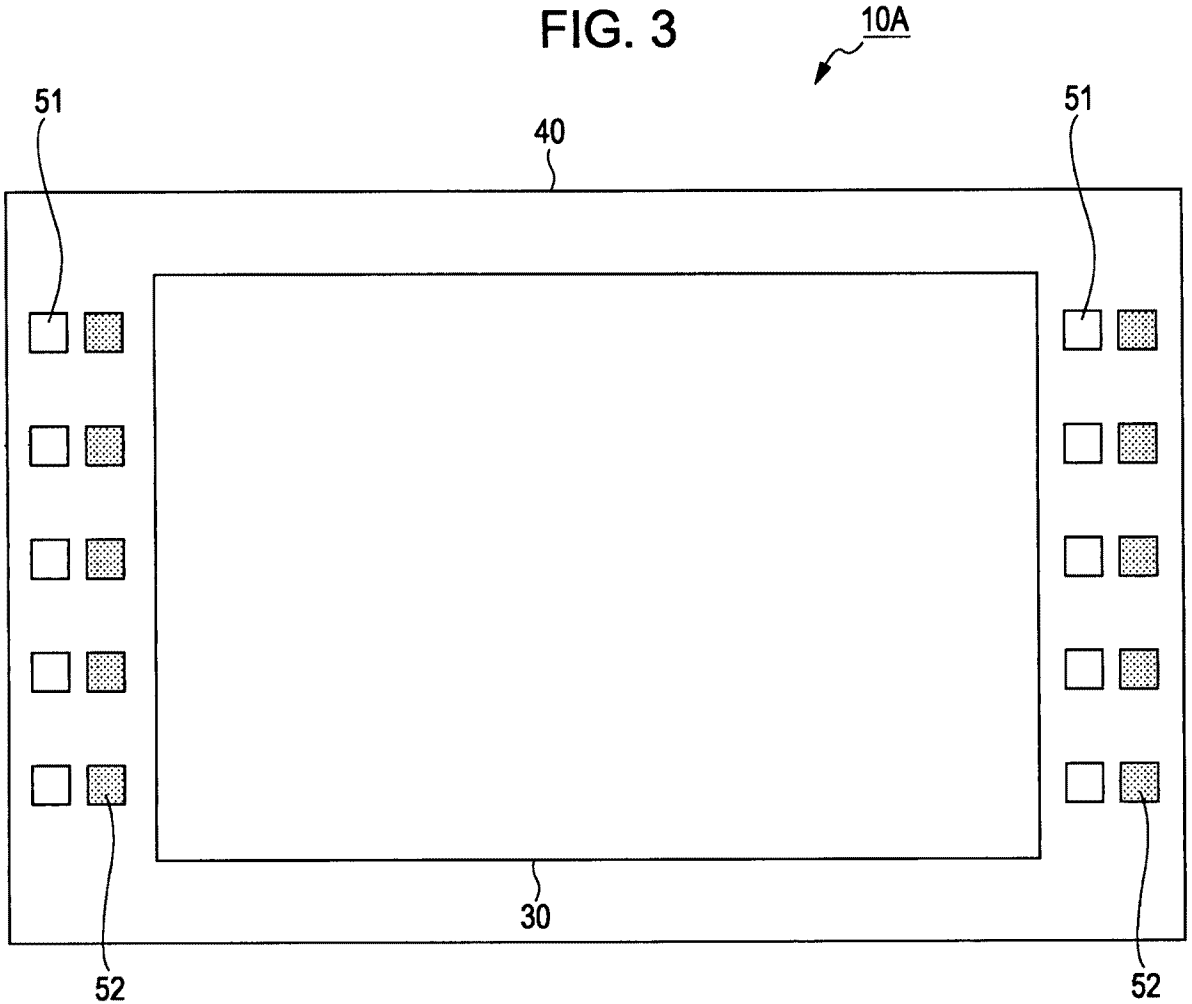
FIG. 3 is a schematic view illustrating a configuration example of an organic EL display device according to a first embodiment of the present invention.

FIG. 3 is a schematic view illustrating a configuration example of an organic EL display device 10A according to a first embodiment of the present invention. In FIG. 3, the parts equivalent (corresponding) to those in FIG. 1 are denoted by the same reference numerals and the detailed description thereof is omitted.

As illustrated in FIG. 3, a plurality of pairs of first and second reference pixel sections 51 and 52 are arranged in a peripheral area of the pixel array section (effective display area) 30 on the display panel 40, e.g., in a blank area (so-called frame area) on both the right and left sides of the pixel array section 30. That is, the first and second reference pixel sections 51 and 52 are arranged in one-to-one correspondence. Also, the first and second reference pixel sections 51 and 52 that form pairs are arranged adjacent to each other.

Figure 4:
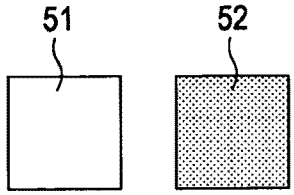
FIG. 4 is a diagram illustrating a positional relationship between a reference pixel section and a degradation measurement pixel section in the organic EL display device according to the first embodiment.

As illustrated in FIG. 4, among the first and second reference pixel sections 51 and 52 adjacent to each other, the first reference pixel section 51 includes dummy pixels for measuring the amount of luminance degradation of the effective pixels 20. Thus, the first reference pixel section 51 is constantly driven to emit light with a predetermined specific color and luminance using a drive method equivalent to that for an effective pixel circuit. Then, the luminance of the first reference pixel section 51 is detected, whereby the amount of luminance degradation of the effective pixels 20 can be estimated on the basis of the detection result. Hereafter, the first reference pixel section 51 is referred to as a degradation measurement pixel section 51. The degradation measurement pixel sections 51 in the plurality of pairs are driven to emit light at different luminances.

On the other hand, the second reference pixel section 52 includes dummy pixels for measuring the luminance in an initial state of the effective pixels 20. Thus, the second reference pixel section 52 is constantly in a light non-emission state and is driven to emit light when the amount of luminance degradation of the effective pixels 20 is to be detected. Then, as described below, the detection result of the first reference pixel section 51 is compared with the detection result of the second reference pixel section 52, with the detection result of the second reference pixel section 52 being a reference, so that the amount of luminance degradation from the initial state of the effective pixels 20 can be estimated. Hereafter, the second reference pixel section 52 is simply referred to as a reference pixel section 52.

The reference pixel sections 52 that are constantly in a light non-emission state are driven to emit light in the same condition as that of the degradation measurement pixel sections 51 only, in the case of detecting (measuring) a luminance degradation state. On the other hand, the degradation measurement pixel sections 51 are constantly driven to emit light under a certain condition throughout a period when the organic EL display device 10A is operating. Here, various conditions may be applied as the certain light emission condition. Examples the condition will be described below.

Example 1 of Light Emission Condition

The degradation measurement pixel sections 51 are constantly driven to emit light at a reference luminance. The reference luminance may be a maximum luminance of the organic EL display device 10A or half of the maximum luminance, for example.

Example 2 of Light Emission Condition

The degradation measurement pixel sections 51 are constantly driven to emit light at an average level of luminance of the display in the entire organic EL display device 10A.

The respective luminances of the degradation measurement pixel sections 51 and the reference pixel sections 52 are detected (measured) by luminance sensors described below. As many pixels as possible are desirably arranged in the degradation measurement pixel sections 51 and the reference pixel sections 52 so that the luminance sensors detect a sufficient amount of light.

For example, when the size of one pixel 20 in the pixel array section 30 is regarded as a reference, each of the degradation measurement pixel sections 51 and the reference pixel sections 52 has several pixels in the vertical direction× several pixels in the horizontal direction, so that the luminance sensors can detect a sufficient amount of light. Also, when each of the degradation measurement pixel sections 51 and the reference pixel sections 52 has pixels the number of which satisfies the amount of light detected by the luminance sensors, a mechanical precision of dimensions for setting the luminance sensors with respect to the degradation measurement pixel sections 51 and the reference pixel sections 52 can be loosened.

However, when too many pixels are arranged in each of the degradation measurement pixel sections 51 and the reference pixel sections 52, the space outside the pixel array section (effective display area) 30 increases, which causes a demerit of increasing design constraints. In addition, the influence of an increase in temperature of pixels that emit light becomes considerable. Thus, it is desirable that the number of pixels arranged is minimized while the amount of light to the luminance sensors is satisfied. Specifically, for example, each of the degradation measurement pixel sections 51 and the reference pixel sections 52 may have the number of pixels to form a 4.5 mm square, which is three times the luminance sensor of a 1.5 mm square.

Examples of Drive to Emit Light

In the example illustrated in FIG. 3, a plurality of pairs of, e.g., five pairs of a degradation measurement pixel section 51 and a reference pixel section 52 are arranged in the frame area on each of the right and left sides of the pixel array section 30, that is, ten pairs in total. In this arrangement example, the following two examples are available regarding drive to emit light of the degradation measurement pixel sections 51 in the ten pairs.

Example 1

In the arrangement example of ten pairs, the degradation measurement pixel sections 51 in the five pairs on one side in the frame area are driven to emit light at different luminances, i.e., at luminances in five levels. Also, the degradation measurement pixel sections 51 in the five pairs on the other side in the frame area are driven to emit light at the luminances in five levels that are the same as those of the five pairs on the one side.

In this way, when the degradation measurement pixel sections 51 in the five pairs on both the right and left sides of the pixel array section 30 are driven to emit light at the same luminances in five levels, the amount of luminance degradation can be detected under the same light emission condition on both the right and left sides. Therefore, the detection accuracy of the amount of luminance degradation can be increased compared to the case of detecting the amount of luminance degradation on only one side in the frame area.

Example 2

In the arrangement example of ten pairs, the degradation measurement pixel sections 51 in the five pairs on one side in the frame area and the degradation measurement pixel sections 51 in the five pairs on the other side in the frame area are driven to emit light at different luminances. That is, the degradation measurement pixel sections 51 in ten pairs in total, five pairs on each side of the pixel array section 30, are driven to emit light at different luminances, i.e., at luminances in ten levels.

In this way, when the degradation measurement pixel sections 51 in the five pairs on both the right and left sides of the pixel array section 30 are driven to emit light at different luminances, the amount of luminance degradation can be detected under luminances in ten levels. Therefore, the resolution of detecting the amount of luminance degradation can be increased compared to the case of detecting the amount of luminance degradation under luminances in five levels.

2-2. Configuration of Luminance Sensor

Luminance sensors are provided on light-emission surfaces of the degradation measurement pixel sections 51 and the reference pixel sections 52, for example. Photodetector elements according to the related art can be used as the luminance sensors. As an example, visible-light sensors including an amorphous silicon semiconductor can be used. The luminance sensors output luminance information (amount-of-light information) detected as a current value, the luminance information being output as a voltage value. Hereinafter, specific examples of an arrangement structure of luminance sensors will be described.

Example 1

Figure 5A:
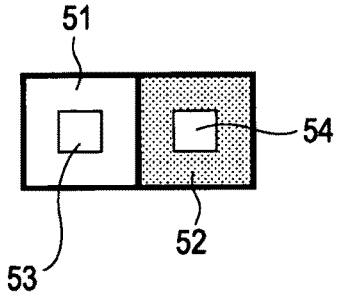
FIGS. 5A and 5B are a plan view and a cross-sectional view, respectively, illustrating an arrangement structure of luminance sensors according to example 1.
Figure 5B:
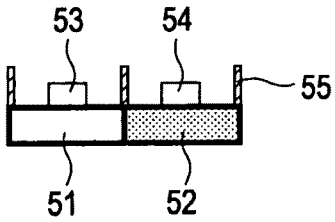

FIGS. 5A and 5B are a plan view and a cross-sectional view, respectively, illustrating an arrangement structure of luminance sensors according to example 1.

As illustrated in FIGS. 5A and 5B, in the arrangement structure of luminance sensors according to example 1, luminance sensors 53 and 54 are arranged on the degradation measurement pixel section 51 and the reference pixel section 52 in one-to-one correspondence. The luminance sensors 53 and 54 are arranged to face the light-receiving surfaces of the degradation measurement pixel section 51 and the reference pixel section 52.

In this arrangement relationship, each of the luminance sensors 53 and 54 is surrounded by a light-shielding plate 55 so that entrance of light from the adjacent pixel section 52 or 51 or light from the outside can be prevented. Also, entrance of light from the pixel sections. 52 and 51 adjacent to the luminance sensors 53 and 54 can be prevented by arranging the luminance sensors 53 and 54 with a sufficient distance therebetween, without the light-shielding plate 55 being provided.

However, when the luminance sensors 53 and 54 are arranged with a sufficient distance therebetween, the effect of arranging the degradation measurement pixel section 51 and the reference pixel section 52 adjacent to each other (the details will be described below) reduces. Thus, it is more desirable to provide the light-shielding plate 55 than arrange the luminance sensors 53 and 54 with a sufficient distance therebetween.

In this way, by providing the luminance sensors 53 and 54 to the degradation measurement pixel section 51 and the reference pixel section 52 in one-to-one correspondence, the individual luminances (amounts of light) of the degradation measurement pixel section 51 and the reference pixel section 52 can be detected (measured) in parallel. Also, since the luminances of the degradation measurement pixel section 51 and the reference pixel section 52 are individually detected by the luminance sensors 53 and 54, the sizes of the degradation measurement pixel section 51 and the reference pixel section 52 are not necessarily the same.

Example 2

Figure 6A:
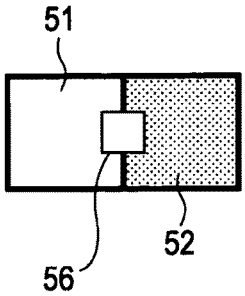
FIGS. 6A and 6B are a plan view and a cross-sectional view, respectively, illustrating an arrangement structure of luminance sensors according to example 2.
Figure 6B:
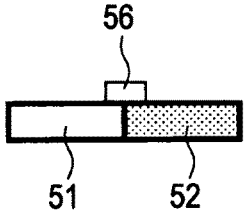

FIGS. 6A and 6B are a plan view and a cross-sectional view, respectively, illustrating an arrangement structure of luminance sensors according to example 2.

As illustrated in FIGS. 6A and 6B, in the arrangement structure of luminance sensors according to example 2, one luminance sensor 56 is arranged at an intermediate position between the degradation measurement pixel section 51 and the reference pixel section 52 on the light receiving surfaces thereof, while extending over the degradation measurement pixel section 51 and the reference pixel section 52.

In the arrangement structure of luminance sensors according to example 1, the luminance sensors 53 and 54 are arranged on the degradation measurement pixel section 51 and the reference pixel section 52, respectively. In this case, it is necessary to determine in advance that the characteristics of the luminance sensors 53 and 54 are equivalent to each other with respect to the degradation measurement pixel section 51 and the reference pixel section 52.

That is, it is necessary to perform calibration on each of the luminance sensors 53 and 54 before measurement for detecting luminance degradation. This calibration operation increases an operation procedure and the cost. In addition, if the number of pixel sections used for comparison is increased to enhance accuracy, the number of luminance sensors increases accordingly. Also, a memory for storing a calibration result is necessary, and the capacity thereof also increases.

On the other hand, according to the arrangement structure of luminance sensors according to example 2, in which a single luminance sensor 56 is used for detecting the luminances of the degradation measurement pixel section 51 and the reference pixel section 52, the necessity of the foregoing calibration operation is eliminated. Also, the number of luminance sensors is reduced to half compared to the case of arranging luminance sensors on the degradation measurement pixel sections 51 and the reference pixel sections 52 in one-to-one correspondence. Furthermore, a memory for storing a calibration result is unnecessary.

Example 3

Figure 7:
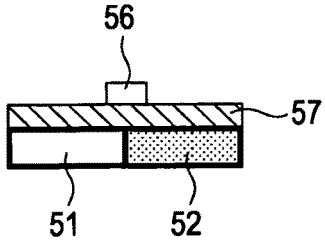
FIG. 7 is a cross-sectional view illustrating an arrangement structure of luminance sensors according to example 3.

FIG. 7 is a cross-sectional view illustrating an arrangement structure of luminance sensors according to example 3.

As illustrated in FIG. 7, in the arrangement structure of luminance sensors according to example 3, as in the arrangement structure of luminance sensors according to example 2, a single luminance sensor 56 is used for detecting the luminances of the degradation measurement pixel section 51 and the reference pixel section 52. In addition, in the arrangement structure of luminance sensors according to example 3, a diffusion plate 57 is disposed between the luminance sensor 56 and a set of the degradation measurement pixel section 51 and the reference pixel section 52.

In this way, when the diffusion plate 57 is disposed between the luminance sensor 56 and a set of the degradation measurement pixel section 51 and the reference pixel section 52, the scattering/diffusion effect of the diffusion plate 57 causes the entire luminance sensor 56 to be irradiated with light emitted from the degradation measurement pixel section 51 and the reference pixel section 52.

2-3. Luminance Degradation Correcting Unit

Next, a description will be given about a configuration and process of a luminance degradation correcting unit 60 that corrects luminance degradation of all the pixels (effective pixels) 20 in the pixel array section 30 on the basis of luminance detection data of the degradation measurement pixel sections 51 and the reference pixel sections 52.

Figure 8:
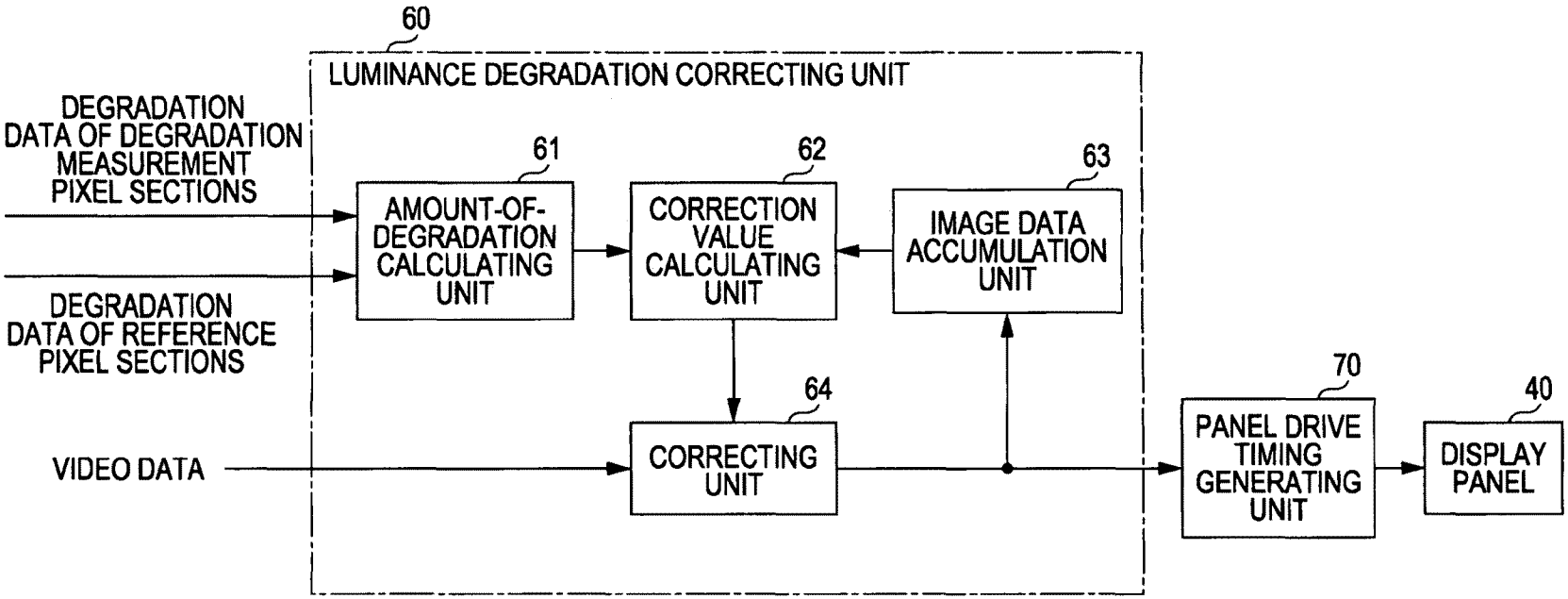
FIG. 8 is a block diagram illustrating an example of a configuration of a luminance degradation correcting unit.

FIG. 8 is a block diagram illustrating an example of a configuration of the luminance degradation correcting unit 60. As illustrated in FIG. 8, the luminance degradation correcting unit 60 according to this example includes an amount-of-degradation calculating unit 61, a correction value calculating unit 62, an image data accumulation unit 63, and a correcting unit 64.

Figure 9:
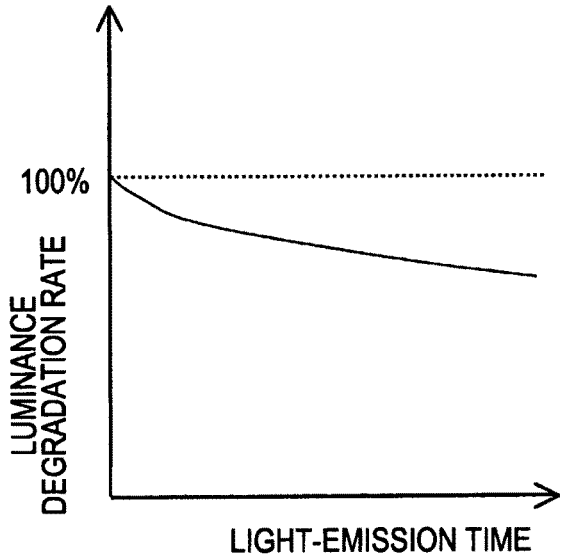
FIG. 9 is a diagram illustrating a luminance degradation rate with respect to light-emission time at a specific luminance.

The amount-of-degradation calculating unit 61 obtains detection results of the luminance sensors 53/56 (hereinafter referred to as "degradation data") in a case where the plurality of degradation measurement pixel sections 51 are caused to emit light at difference luminances, thereby calculating a luminance degradation rate (the amount of degradation) with respect to the light-emission time in a reference luminance. FIG. 9 illustrates the luminance degradation rate with respect to the light-emission time in a specific luminance.

Figure 10:
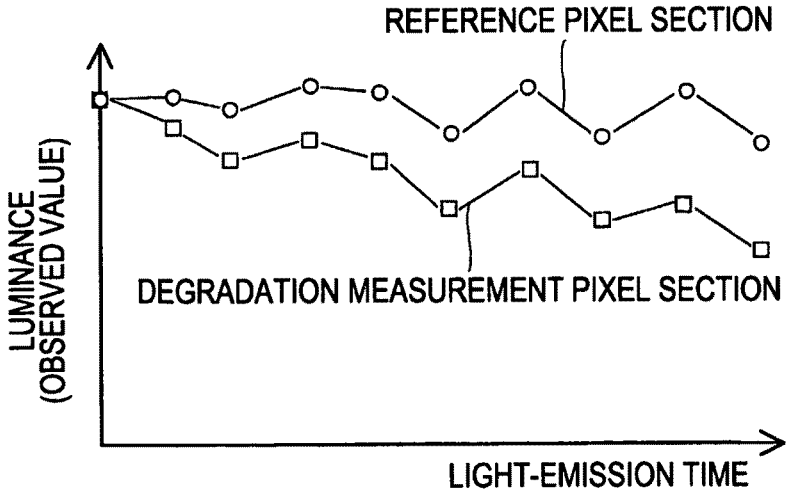
FIG. 10 is a diagram illustrating changes in detected luminances (observed values) with respect to light-emission time in a degradation measurement pixel section and a reference pixel section.

FIG. 10 is a diagram illustrating changes in detected luminances (observed values) with respect to the light-emission time of the degradation measurement pixel sections 51 and the reference pixel sections 52. In FIG. 10, the reason why the detected luminances do not decrease in proportion to the light-emission time, that is, the reason why the detected luminances fluctuate up and down, is that the organic EL display device 10 is affected by conditions of environment where the device is placed, specifically, by the temperature and brightness of the environment.

Figure 11:
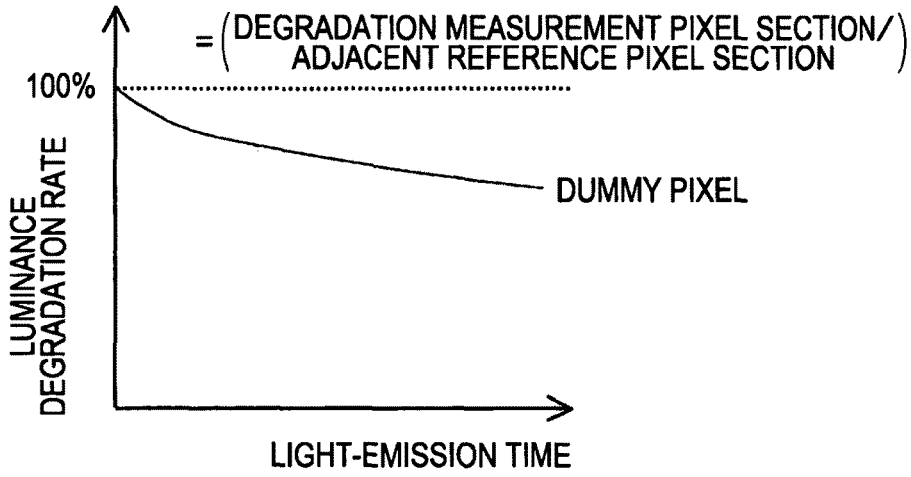
FIG. 11 is a diagram illustrating a luminance degradation rate with respect to light-emission time in a degradation measurement pixel section.
Figure 12:
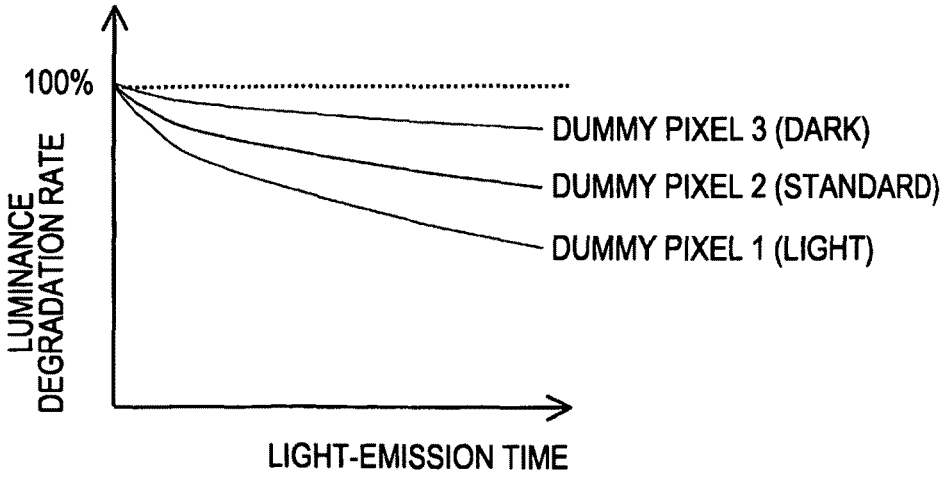
FIG. 12 is a diagram illustrating luminance degradation rates with respect to light-emission time in a degradation measurement pixel section in a case where three types of luminances are set in the degradation measurement pixel section.
Figure 13:
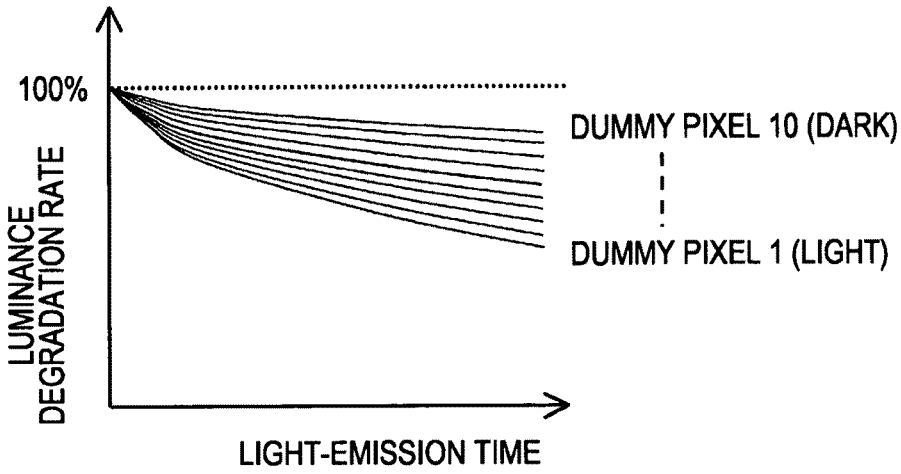
FIG. 13 is a diagram illustrating luminance degradation rates with respect to light-emission time in a degradation measurement pixel section in a case where ten types of luminances are set in the degradation measurement pixel section.

Then, the amount-of-degradation calculating unit 61 performs calculation by dividing the degradation data about the degradation measurement pixel sections 51 by the degradation data about the reference pixel sections 52, so that the degradation rate (the amount of degradation) of the degradation measurement pixel sections 51 with respect to the light-emission time can be obtained. FIG. 11 is a diagram illustrating the luminance degradation rate of the degradation measurement pixel sections 51 with respect to the light-emission time. FIG. 12 illustrates the luminance degradation rates of the degradation measurement pixel sections 51 with respect to the light-emission time in a case where three types of luminances are set for the degradation measurement pixel sections 51. Also, FIG. 13 illustrates the luminance degradation rates of the degradation measurement pixel sections 51 with respect to the light-emission time in a case where ten types of luminance are set for the degradation measurement pixel sections 51.

Figure 14:
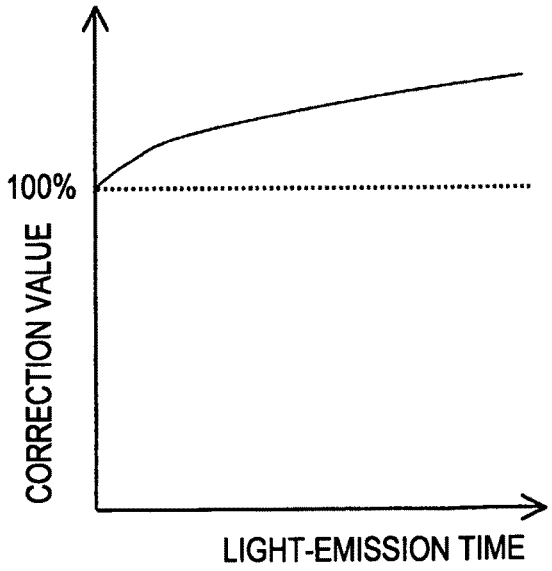
FIG. 14 is a diagram illustrating a correction value for luminance degradation of effective pixels with respect to light-emission time.

The correction value calculating unit 62 calculates a correction value of luminance degradation for all the effective pixels 20 on the basis of the amount of degradation (degradation rate) calculated by the amount-of-degradation calculating unit 61 and the information given from the image data accumulation unit 63. FIG. 14 illustrates a correction value of luminance degradation for the effective pixels 20 with respect to the light-emission time. The image data accumulation unit 63 accumulates image data in which luminance degradation has been corrected by the correcting unit 64 and calculates the time corresponding to the light-emission time of each of the effective pixels 20.

The correcting unit 64 performs a correction process in units pixels on video data input thereto on the basis of the correction value of luminance degradation calculated by the correction value calculating unit 62. The video data in which luminance degradation has been corrected is supplied to the image data accumulation unit 63 and is supplied to a panel drive timing generating unit 70. The panel drive timing generating unit 70 corresponds to the above-described drive unit that drives the individual pixels 20 in the pixel array section 30, and includes a write scanning unit, a power supply unit, and a signal supply unit.

A description has been given about an example of the configuration of the luminance degradation correcting unit 60, but the configuration of the luminance degradation correcting unit 60 is not limited thereto. That is, any other configuration may be employed as long as the luminance degradation of the effective pixels 20 can be corrected on the basis of the degradation data about the degradation measurement pixel sections 51 and the degradation data about the reference pixel sections 52.

2-4. Method for Measuring the Amount of Luminance Degradation

Figure 15:
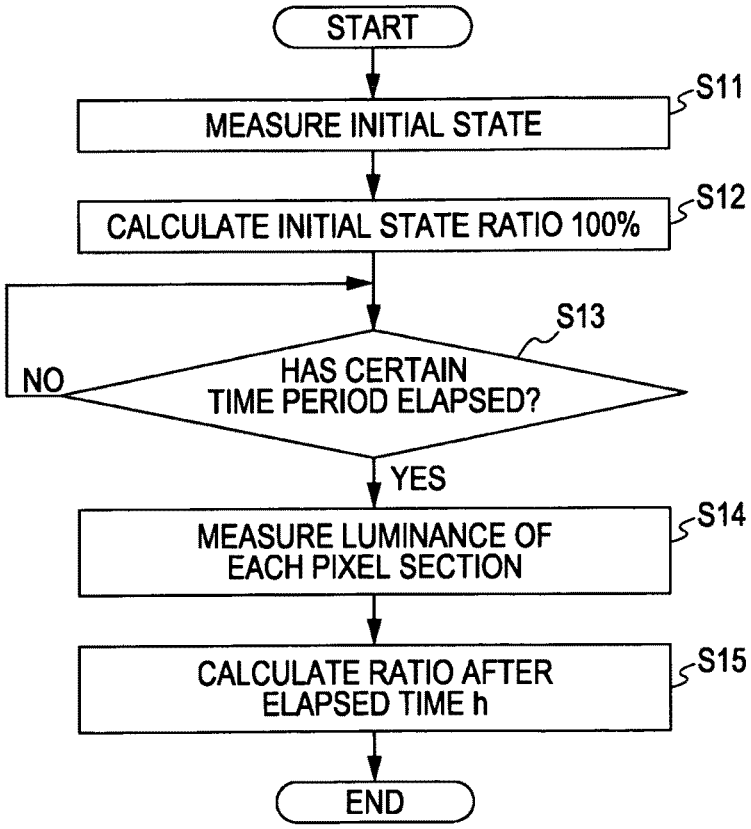
FIG. 15 is a flowchart illustrating an example of a process of measuring the amount of luminance degradation.

Next, a method for measuring the amount of luminance degradation will be described with reference to the flowchart in FIG. 15. Here, a description will be given about the case of the arrangement structure of luminance sensors according to example 1, that is, the arrangement structure in which the luminance sensors 53 and 54 are arranged on the degradation measurement pixel sections 51 and the reference pixel sections 52 in one-to-one correspondence.

First, the initial state of the degradation measurement pixel sections 51 and the reference pixel sections 52 is observed (step S11). In order to observe the initial state, the degradation measurement pixel sections 51 and the reference pixel sections 52 adjacent thereto are caused to emit the same amounts of light, and the amounts of light (luminances) are measured by using the respective luminance sensors 53 and 54. At this time, the amounts of light are desirably sufficient for obtaining the accuracy that is necessary for measurement performed by the luminance sensors 53 and 54 and comparison.

With the measurement of the luminances in the initial state, the initial luminances of the degradation measurement pixel sections 51 and the initial luminances of the reference pixel sections 52 adjacent thereto can be obtained. Note that, since the measurement values contain a measurement error and variations in characteristics of the luminance sensors 53 and 54, the initial measurement values do not necessarily match, but vary in many cases.

Then, the ratio of values obtained by observing the initial state is regarded as an initial state (elapsed time=0) ratio 100%.

Initial state ratio 100% (zero time elapsed)=sensor measurement value (luminance of degradation measurement pixel sections)/sensor measurement value (luminance of reference pixel sections) (1)

Next, a description will be given about a condition during the time until the degradation state of the effective pixels 20 is measured. The reference pixel sections 52 are constantly kept in a light non-emission state and are caused to emit light under the same condition as that for the degradation measurement pixel sections 51 only when a degradation state is to be measured.

The degradation measurement pixel sections 51 are constantly kept in a light-emission state under a certain condition while the organic EL display device 10 is operating. Here, various conditions are applied as the certain condition, and examples thereof will be described below.

Display Example 1

The degradation measurement pixel sections 51 are caused to emit light at a reference luminance, for example, at a maximum luminance of the organic EL display device 10 or half of the maximum luminance of the organic EL display device 10.

Display Example 2

The degradation measurement pixel sections 51 are caused to emit light at an average level of display in the entire organic EL display device 10.

After the initial state ratio 100% has been calculated, it is determined whether a certain time period has elapsed (step S13). After the certain time period has elapsed, the luminances of the degradation measurement pixel sections 51 and the reference pixel sections 52 adjacent thereto are measured by using the luminance sensors 53 and 54 in the same manner as that of measuring the initial state (step S14).

Ideally, the measurement intervals of the luminances of the degradation measurement pixel sections 51 and the reference pixel sections 52 are short as much as possible. In a case where degradation characteristics of the elements can be estimated in advance, measurement is performed at the intervals in which degradation is less than 1% and then correction is performed. Accordingly, the display quality of the organic EL display device 10 is not impaired in many cases. However, the foregoing measurement intervals are ideal measurement intervals. The measurement intervals may be set more appropriately in accordance with the content to be displayed, the purpose of use, and the characteristics of the display device.

Next, the ratio after the elapsed time h is calculated on the basis of the following equation (2) by using the values obtained through the measurement in the luminance sensors 53 and 54.

Degradation rate (elapsed time h)=sensor measurement value (luminance of degradation measurement pixel sections)/sensor measurement value (luminance of reference pixel sections) (2)

Through the calculation based on equation (2), the degradation rate after the elapsed time h of the measured elements, that is, the degradation measurement pixel sections 51, can be obtained.

At the time point at which the time h has elapsed from the initial state, the environment may be significantly different from that in the initial state. For example, even if a reference value is measured in the initial state under a condition in which the temperature and humidity are kept constant in a manufacturing factory of the organic EL display device 10, the environmental condition can vary after the time h has elapsed.

That is, after the time h has elapsed, luminance is measured in the environment where the organic EL display device 10 is used, and thus it is difficult to estimate the condition including temperature and humidity under which the organic EL display device 10 is used. Therefore, variations in characteristics of the luminance sensors 53 and 54 due to temperature and humidity and the temperature characteristic of the organic EL display device 10 itself directly affect measurement values.

However, when the degradation measurement pixel sections 51 and the reference pixel sections 52 adjacent thereto are caused to emit a sufficient amount of light for obtaining the accuracy in comparing detection results of the luminance sensors 53 and 54 and when the detection results are compared, the degree of degradation can be obtained with the influence of a change in environment being canceled. Furthermore, the degree of degradation of the measured elements obtained at this time is represented by a ratio, which is apparent.

The description given above is about a method for measuring the amount of luminance degradation in the case of the arrangement structure of luminance sensors according to example 1. The method is basically the same in the case of the arrangement structures of luminance sensors according to examples 2 and 3. Also, in the case of the arrangement structures of luminance sensors according to examples 2 and 3, that is, in the case of the arrangement structure in which a single luminance sensor 56 is shared by a degradation measurement pixel section 51 and a reference pixel section 52, variations in characteristics of luminance sensors and a measurement error caused by environment can be eliminated.

2-5. Operation and Effect of First Embodiment

As described above, a process of correcting luminance degradation of the effective pixels 20 is performed by using the degradation measurement pixel sections 51 and the reference pixel sections 52 on the basis a detection result of the respective luminances of those pixel sections 51 and 52. Accordingly, the following operation and effect can be obtained.

That is, the degradation measurement pixel sections 51 are driven to emit light at predetermined luminances, and the luminances of the degradation measurement pixel sections 51 are detected, whereby a detection result of the luminances of the degradation measurement pixel sections 51 in which luminance degradation progresses can be obtained in accordance with a condition of environment where the organic EL display device 10A is placed. On the basis of the detection result obtained after luminance degradation has occurred, the amount of luminance degradation of the effective pixels 20 in which luminance degradation progresses can be estimated in accordance with a condition of environment where the organic EL display device 10A is placed.

On the other hand, the reference pixel sections 52 are driven to emit light when the amount of luminance degradation is to be detected, and the luminances of the reference pixel sections 52 are detected, whereby a detection result of the luminances of the reference pixel sections 52 in the initial state where no luminance degradation has occurred can be obtained in accordance with a condition of environment where the organic EL display device 10A is placed. On the basis of the detection result obtained in the initial luminance state, the luminance of the effective pixels 20 in the initial state can be estimated in accordance with a condition of environment where the organic EL display device 10A is placed.

That is, both the detection result of the luminances of the degradation measurement pixel sections 51 and the detection result of the luminances of the reference pixel sections 52 are detection results based on a condition of environment where the organic EL display device 10A is placed. On the basis of the detection result of the luminances of the degradation measurement pixel sections 51 and the reference pixel sections 52, the amount of luminance degradation of the effective pixels 20 from the initial state can be obtained while eliminating the influence of the condition of environment where the organic EL display device 10A is placed.

Then, the luminances of the effective pixels 20 are controlled on the basis of the amount of degradation calculated from the detection result of the luminances of the degradation measurement pixel sections 51 and the reference pixel sections 52, whereby the luminance degradation of the effective pixels 20 from the initial state can be corrected. That is, since both the detection result of the luminances of the degradation measurement pixel sections 51 and the detection result of the luminances of the reference pixel sections 52 are detection results based on the condition of environment where the organic EL display device 10A is placed, the amount of luminance degradation of the effective pixels 20 can be detected without being affected by the environmental condition.

3. Second Embodiment

3-1. Configuration of Reference Pixel Section

Figure 16:
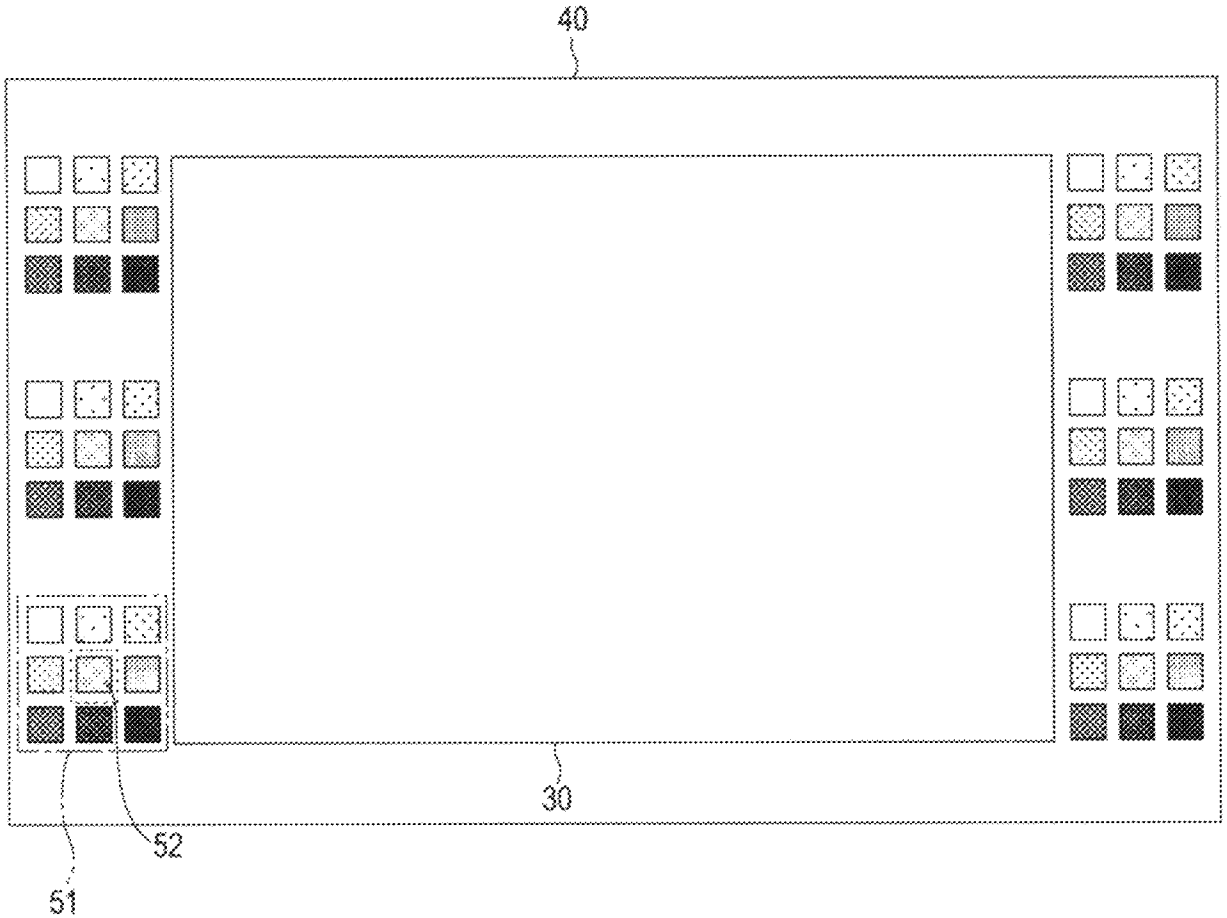
FIG. 16 is a schematic view illustrating a configuration example of an organic EL display device according to a second embodiment of the present invention.

FIG. 16 is a schematic view illustrating a configuration example of an organic EL display device 10B according to a second embodiment of the present invention. In FIG. 16, the parts equivalent (corresponding) to those in FIG. 3 are denoted by the same reference numerals, and the detailed description thereof is omitted.

As illustrated in FIG. 16, sets each having one reference pixel section (second reference pixel section) 52 and a plurality of degradation measurement pixel sections (first reference pixel sections) 51 are arranged in a peripheral area of the pixel array section 30 on the display panel 40, e.g., in a frame area on both the right and left sides of the pixel array section 30. In this embodiment, a plurality of sets of, i.e., six sets of one reference pixel section 52 and a plurality of degradation measurement pixel sections 51 are provided in the frame area on the right and left sides.

Figure 17:
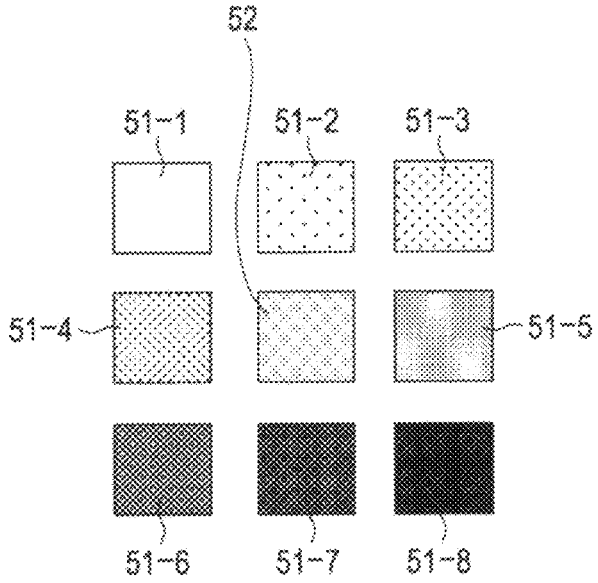
FIG. 17 is a diagram illustrating a positional relationship between a reference pixel section and degradation measurement pixel sections in the organic EL display device according to the second embodiment.

Specifically, as illustrated in FIG. 17, a set of one reference pixel section 52 and a plurality of degradation measurement pixel sections 51 has a configuration in which the reference pixel section 52 is at the center and eight degradation measurement pixel sections 51-1 to 51-8 are arranged around the reference pixel section 52. That is, the eight degradation measurement pixel sections 51-1 to 51-8 are arranged adjacent to the reference pixel section 52 in the horizontal, vertical, and oblique directions with respect to the reference pixel section 52.

The eight degradation measurement pixel sections 51-1 to 51-8 include dummy pixels used for measuring the amounts of luminance degradation of the respective effective pixels 20 in the pixel array section 30. The degradation measurement pixel sections 51-1 to 51-8 are constantly driven to emit light at a predetermined specific luminance. By detecting the luminances of the eight degradation measurement pixel sections 51-1 to 51-8, the amounts of degradation of the respective luminances of the effective pixels 20 can be estimated on the basis of the detection result.

On the other hand, the reference pixel section 52 includes dummy pixels used for measuring the luminances of the effective pixels 20 in the initial state. The reference pixel section 52 is constantly in a light non-emission state and is driven to emit light when the amounts of luminance degradation of the effective pixels 20 are to be detected. As in the first embodiment, a detection result of the reference pixel section 52 is regarded as a reference, and the detection result of the reference pixel section 52 is compared with a detection result of the degradation measurement pixel sections 51-1 to 51-8. Accordingly, the amount of luminance degradation of the effective pixels 20 from the initial state can be estimated.

As in the first embodiment, the respective luminances of the degradation measurement pixel sections 51-1 to 51-8 and the reference pixel section 52 are detected (measured) by luminance sensors. As many pixels as possible are desirably arranged in the degradation measurement pixel sections 51-1 to 51-8 and the reference pixel section 52 so that the luminance sensors detect a sufficient amount of light.

For example, when the size of one pixel 20 in the pixel array section 30 is regarded as a reference, each of the degradation measurement pixel sections 51-1 to 51-8 and the reference pixel section 52 has several pixels in the vertical direction×several pixels in the horizontal direction, so that the luminance sensors can detect a sufficient amount of light. Also, when each of the degradation measurement pixel sections 51-1 to 51-8 and the reference pixel section 52 has pixels the number of which satisfies the amount of light detected by the luminance sensors, a mechanical precision of dimensions for setting the luminance sensors with respect to the degradation measurement pixel sections 51-1 to 51-8 and the reference pixel section 52 can be loosened.

However, when too many pixels are arranged in each of the degradation measurement pixel sections 51-1 to 51-8 and the reference pixel section 52, the space in the frame area increases, which causes a demerit of increasing design constraints. In addition, the influence of an increase in temperature of pixels that emit light becomes considerable. Thus, it is desirable that the number of pixels arranged is minimized while the amount of light to the luminance sensors is satisfied. Specifically, for example, each of the degradation measurement pixel sections 51-1 to 51-8 and the reference pixel section 52 may have the number of pixels to form a 4.5 mm square, which is three times the luminance sensor of a 1.5 mm square.

Here, the reference pixel section 52 that is constantly in a light non-emission state is driven to emit light in the same condition as that for the degradation measurement pixel sections 51 only when a luminance degradation state is to be detected (measured). On the other hand, a plurality of light emission conditions can be set for the eight degradation measurement pixel sections 51-1 to 51-8.

Specifically, light emission using example 1 of light emission condition (at the maximum luminance or half of the maximum luminance of the organic EL display device 10B) and light emission using example 2 of light emission condition (at the average level of luminance of display in the entire organic EL display device 10B) according to the first embodiment can be performed at the same time. Alternatively, the following condition is available as another example of light emission condition. That is, one of the eight degradation measurement pixel sections 51-1 to 51-8 is driven to emit light at an average level of luminance of display in the entire organic EL display device 10B, and the other seven pixel sections are driven to emit light at reference luminances in seven levels different from each other.

3-2. Configuration of Luminance Sensor

As in the first embodiment, visible light sensors using an amorphous silicon semiconductor can be used as luminance sensors. Also, in the relationship between the degradation measurement pixel sections 51-1 to 51-8 and the reference pixel section 52, the arrangement structure of luminance sensors according to example 1 or example 3 in the first embodiment can be employed.

In the Case of Example 1

As in the case of the arrangement structure according to example 1 in the first embodiment, luminance sensors are arranged on the degradation measurement pixel sections 51-1 to 51-8 and the reference pixel section 52 in one-to-one correspondence (see FIGS. 5A and 5B). At this time, the luminance sensors are arranged to face the light receiving surfaces of the degradation measurement pixel sections 51-1 to 51-8 and the reference pixel section 52.

In this way, by arranging the luminance sensors on the degradation measurement pixel sections 51-1 to 51-8 and the reference pixel section 52 in one-to-one correspondence, the luminances (amounts of light) of the respective pixel sections 51-1 to 51-8 and 52 can be detected (measured) in parallel. Also, the luminances of the respective pixel sections 51-1 to 51-8 and 52 are individually detected by the luminance sensors, and thus the sizes of the degradation measurement pixel sections 51-1 to 51-8 and the reference pixel section 52 are not necessarily the same.

In the Case of Example 3

As in the case of the arrangement structure according to example 3 in the first embodiment, a single luminance sensor is shared by the degradation measurement pixel sections 51-1 to 51-8 and the reference pixel section 52. Also, a diffusion plate is disposed between the luminance sensor and the set of the degradation measurement pixel sections 51-1 to 51-8 and the reference pixel section 52 (see FIG. 7).

In this way, when a diffusion plate is disposed between the single luminance sensor and the set of the degradation measurement pixel sections 51-1 to 51-8 and the reference pixel section 52, the scattering/diffusion effect of the diffusion plate causes light emitted from the respective pixel sections 51-1 to 51-8 and 52 to enter the single luminance sensor. Therefore, a plurality of degradation measurement pixel sections 51 can be arranged adjacent to a reference pixel section 52 at the center, and a single luminance sensor can be shared by the plurality of degradation measurement pixel sections 51 advantageously.

In the organic EL display device 10B having the above-described configuration according to the second embodiment, correction of luminance degradation and measurement of the amount of luminance degradation based on a detection result (degradation data) output from luminance sensors are performed in basically the same manner as in the organic EL display device 10A according to the first embodiment. Thus, the detailed description thereof is omitted.

3-3. Operation and Effect of Second Embodiment

In the case of the organic EL display device 10B according to this embodiment, the operation and effect that are basically similar to those in the case of the organic EL display device 10A according to the first embodiment can be obtained. That is, the amount of luminance degradation of the effective pixels 20 can be detected without being affected by a condition of environment where the organic EL display device 10B is placed. In addition, in the case of the organic EL display device 10B according to this embodiment, a plurality of light emission conditions can be set for the degradation measurement pixel sections 51-1 to 51-8, and thus a degradation status for a finer correction can be recognized.

4. Modification

In the above-described embodiments, a description has been given about the case of applying an embodiment to an organic EL display device including organic EL elements serving as electro-optical elements (light-emitting elements) of the pixels 20. Alternatively, another application is also acceptable. That is, an embodiment of the present invention can be applied to light-emitting display devices in which light-emitting elements, such as inorganic EL elements, light-emitting diode (LED) elements, and semiconductor laser elements, are used as electro-optical elements of the pixels 20.

5. Applications

The above-described display devices according to the embodiments of the present invention can be applied to display devices of electronic apparatuses in various fields for displaying video signals input to the electronic apparatus or video signals generated in the electronic apparatus as an image or video. For example, the display devices according to the embodiments of the present invention can be applied to display devices of the various electronic apparatuses illustrated in FIGS. 18 to 22G, such as a digital camera, a notebook personal computer, a mobile terminal apparatus such as a mobile phone, and a video camera.

In this way, by using the display devices according to the embodiments of the present invention as display devices of electronic apparatuses in various fields, high-quality images can be displayed in the various electronic apparatuses. That is, as is clear from the description given above in the embodiments, the display devices according to the embodiments of the present invention are capable of reliably detecting the amount of luminance degradation of light-emitting elements and correcting the luminance degradation of the light-emitting elements on the basis of the detection result. Accordingly, high-quality images can be displayed.

The display devices according to the embodiments of the present invention include a module-type display device having a sealed configuration, e.g., a display module that is formed by pasting an opposed portion, such as a transparent glass, to the pixel array section 30. A color filter, a protective film, or the above-described light-shielding film may be provided on the transparent opposed portion. Also, the display module may be provided with a circuit unit for externally inputting/outputting signals or the like to/from the pixel array section, a flexible printed circuit (FPC), and the like.

Hereinafter, a description will be given about specific examples of electronic apparatuses to which an embodiment of the present invention is applied.

Figure 18:
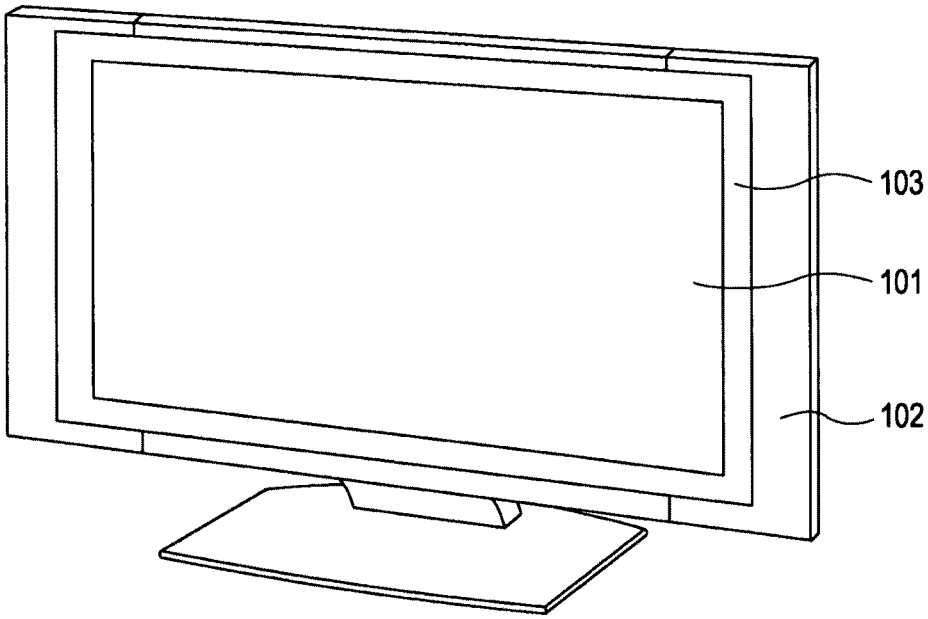
FIG. 18 is a perspective view illustrating an appearance of a television set to which an embodiment of the present invention is applied.

FIG. 18 is a perspective view illustrating an appearance of a television set to which an embodiment of the present invention is applied. The television set according to this application example includes a video display screen unit 101 including a front panel 102 and a filter glass 103, and is fabricated by using the display device according to any of the embodiments of the present invention as the video display screen unit 101.

Figure 19A:
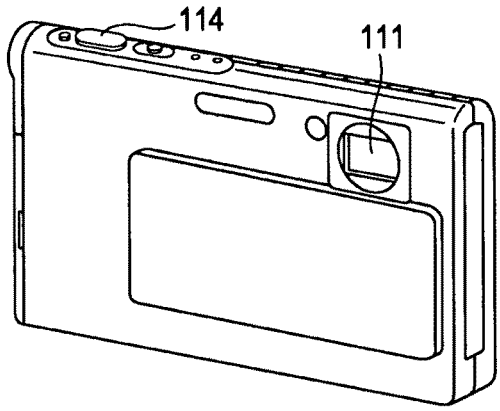
FIGS. 19A and 19B are perspective views of a front side and a rear side, respectively, illustrating appearances of a digital camera to which an embodiment of the present invention is applied.
Figure 19B:
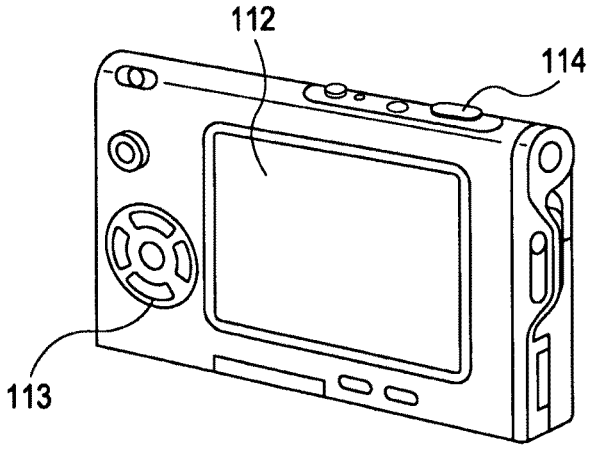

FIGS. 19A and 19B are perspective views illustrating appearances of a digital camera to which an embodiment of the present invention is applied. FIG. 19A is a perspective view of a front side and FIG. 19B is a perspective view of a rear side. The digital camera according to this application example includes a strobe light emitting unit 111, a display unit 112, a menu switch 113, and a shutter button 114, and is fabricated by using the display device according to any of the embodiments of the present invention as the display unit 112.

Figure 20:
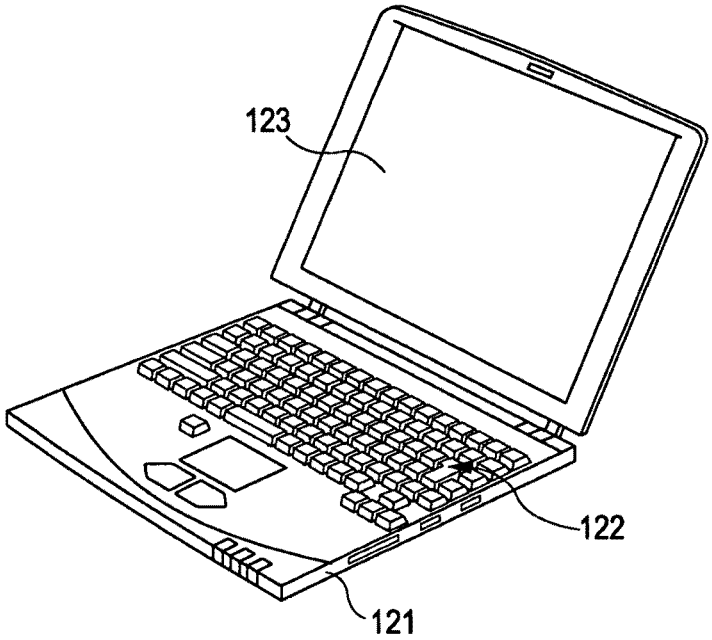
FIG. 20 is a perspective view illustrating an appearance of a notebook personal computer to which an embodiment of the present invention is applied.

FIG. 20 is a perspective view illustrating an appearance of a notebook personal computer to which an embodiment of the present invention is applied. The notebook personal computer according to this application example includes a main body 121, a keyboard 122 that is operated to input characters and the like, and a display unit 123 that displays images, and is fabricated by using the display device according to any of the embodiments of the present invention as the display unit 123.

Figure 21:
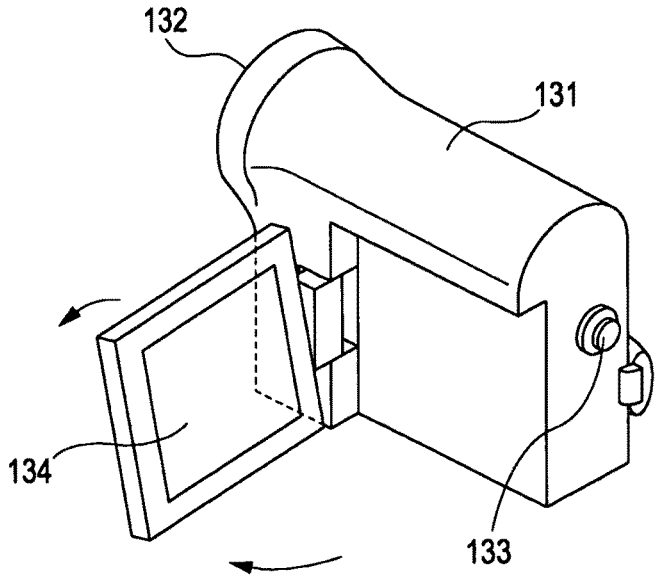
FIG. 21 is a perspective view illustrating an appearance of a video camera to which an embodiment of the present invention is applied.

FIG. 21 is a perspective view illustrating an appearance of a video camera to which an embodiment of the present invention is applied. The video camera according to this application example includes a main body unit 131, a lens 132 that is used for taking an image of a subject and that is disposed on a front side, a shooting start/stop switch 133, and a display unit 134, and is fabricated by using the display device according to any of the embodiments of the present invention as the display unit 134.

Figure 22A:
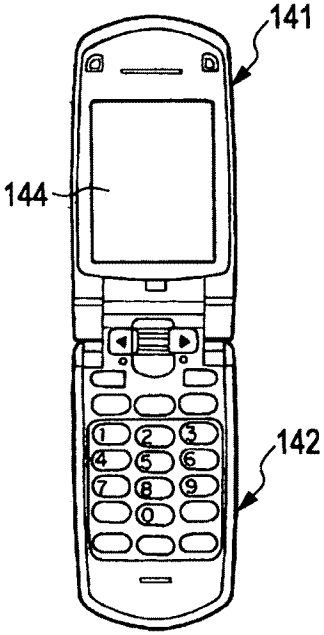
Figure 22B:
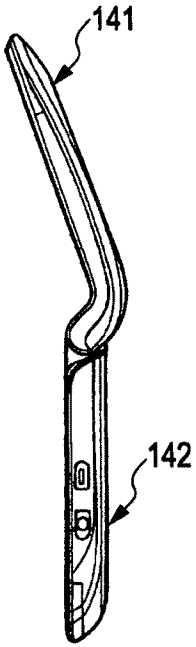
Figure 22D:
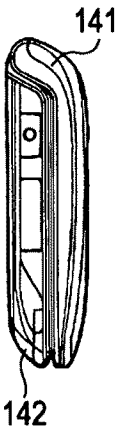
Figure 22C:
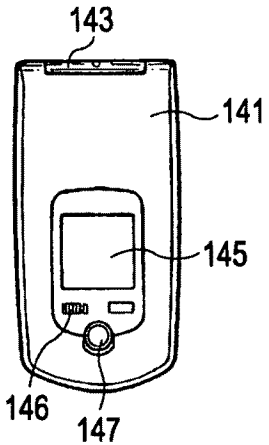
Figure 22E:
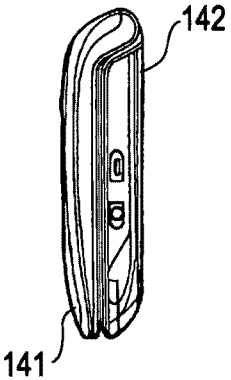
Figure 22F:
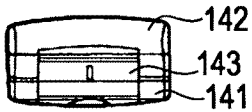
Figure 22G:
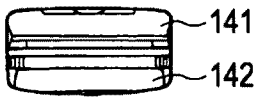

FIGS. 22A to 22G illustrate appearances of a mobile terminal apparatus to which an embodiment of the present invention is applied, such as a mobile phone. FIG. 22A is a front view illustrating an open state, FIG. 22B is side view thereof, FIG. 22C is a front view illustrating a closed state, FIG. 22D is a left side view, FIG. 22E is a right side view, FIG. 22F is a top view, and FIG. 22G is a bottom view. The mobile phone according to this application example includes an upper casing 141, a lower casing 142, a coupling unit (hinge unit) 143, a display 144, a sub-display 145, a picture light 146, and a camera 147. The mobile phone according to this application example is fabricated by using the display device according to any of the embodiments of the present invention as the display 144 and the sub-display 145.

The present application contains subject matter related to that disclosed in Japanese Priority Patent Application JP 2009-187004 filed in the Japan Patent Office on Aug. 12, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a plurality of display pixels configured to collectively display an image;

a plurality of reference pixels comprising first reference pixels and second reference pixels, wherein the plurality of reference pixels do not contribute to display of the image and each of the plurality of reference pixels is configured to emit light having luminance based on an input signal voltage;

a control unit configured to drive the plurality of reference pixels and to:

drive the first reference pixels to emit light such that a cumulative duration of light emission for the first reference pixels substantially corresponds to a cumulative duration of light emission for the plurality of display pixels, drive the second reference pixels to emit light infrequently such that the second reference pixels approximate new pixels without current degradation;

perform luminance degradation detection by:

driving the first reference pixels to emit light by applying thereto respective predetermined input signal voltages, detecting luminances of light emitted by the first reference pixels, driving the second reference pixels to emit light by applying thereto respective predetermined input signal voltages, and detecting luminances of light emitted by the second reference pixels; and a correcting unit configured to correct luminance degradation of display pixels on the basis of a detection result of luminance degradation detection, wherein detected luminances of light emitted by the second reference pixels during luminance degradation detection are used as a reference for approximating an initial state of the display pixels.

2. The display device of claim 1, wherein the control circuit is configured to drive the first reference pixels to emit light by applying thereto respective predetermined input signal voltages whenever the plurality of display pixels are driven to emit light.

3. The display device of claim 1, wherein the control circuit is configured to drive the second reference pixels to emit light only when performing luminance degradation detection.

4. The display device according to claim 1, wherein the first reference pixels are arranged in a first reference pixel section and the second reference pixels are arranged in a second reference pixel section, the first reference pixel section and the second reference pixel section being adjacent to each other in a peripheral portion of a display section in which the display pixels are arranged.

5. The display device according to claim 4, wherein both the first reference pixel section and the second reference pixel section are arranged on both sides of the display section.

6. The display device according to claim 1, further comprising:

a first luminance sensor configured to detect luminance degradation of the first reference pixel section; and a second luminance sensor configured to detect luminance degradation of the second reference pixel section.

7. The display device according to claim 6, wherein the first luminance sensor and the second luminance sensor are surrounded respective light-shielding plates.

8. The display device according to claim 4, wherein the first reference pixel section includes a plurality of first reference pixel subsections, and wherein, for each of the plurality of first reference pixel subsections, a same predetermined input signal voltage is applied to each of the first reference pixels included in a same one of the plurality of first reference pixel subsections when they are driven to emit light, and the predetermined input signal voltages are different between at least some of the plurality of first reference pixel subsections.

9. The display device according to claim 8, wherein the second reference pixel section includes a plurality of second reference pixel subsections, and wherein, for each of the plurality of second reference pixel subsections, a same predetermined input signal voltage is applied to each of the second reference pixels included in a same one of the plurality of second reference pixel subsections when they are driven to emit light, and the predetermined input signal voltages are different between at least some of the plurality of second reference pixel subsections.

10. The display device according to claim 9, wherein the plurality of first reference pixel subsections are arranged in one-to-one correspondence with the plurality of second reference pixel subsections forming pairs of subsections that each include one of the plurality of first reference pixel subsections and a corresponding one of the plurality of second reference pixel subsections, and wherein, for each of the pairs of subsections, a same predetermined input signal voltage is applied to the first and second reference pixels included in a same pair of subsections.

11. The display device according to claim 9, wherein the predetermined input signal voltages are different between each of the plurality of first reference pixel subsections, and wherein the predetermined input signal voltages are different between each of the plurality of first reference pixel subsections.

12. The display device according to claim 9, wherein the first reference pixel section and the second reference pixel section are arranged in sets of first and second reference pixel subsections, wherein each set of the first and second reference pixel subsections includes a single corresponding second reference pixel subsection, and wherein each set of the first and second reference pixel subsections includes a plurality of first reference pixel subsections that are arranged around the corresponding single second reference pixel subsection.

13. The display device according to claim 9, further comprising:

a plurality of first luminance sensors corresponding respectively to the plurality of first reference pixel subsections and each configured to detect luminance degradation of the one of the plurality of first reference pixel sections corresponding thereto; and a plurality of second luminance sensors corresponding respectively to the plurality of second reference pixel subsections and each configured to detect luminance degradation of the one of the plurality of second reference pixel sections corresponding thereto.

14. The display device according to claim 10, wherein both the first reference pixel section and the second reference pixel section are arranged on two sides of the display section, wherein each pair of subsections on one of said two sides of the display sections corresponds to a pair of subsections on the other of said two sides of the display section, and wherein a same predetermined input signal voltage is applied to the first and second reference pixels included in corresponding pairs of subsections.

15. The display device according to claim 12, wherein sets of first and second reference pixel subsections are arranged on two sides of the display section.

16. The display device according to claim 13, wherein the first luminance sensor and the second luminance sensor are surrounded respective light-shielding plates.

17. A method of correcting degradation of pixels, comprising:

driving first reference pixels, which do not contribute to display of images displayed by display pixels, to emit light such that a cumulative duration of light emission for the first reference pixels substantially corresponds to a cumulative duration of light emission for the plurality of display pixels;

driving second reference pixels, which do not contribute to display of images displayed by the display pixels, to emit light infrequently such that the second reference pixels approximate new pixels;

performing luminance degradation detection by:

driving the first reference pixels to emit light by applying thereto respective predetermined input signal voltages, detecting luminances of light emitted by the first reference pixels, driving the second reference pixels to emit light by applying thereto respective predetermined input signal voltages, and detecting luminances of light emitted by the second reference pixels, correcting luminance degradation of display pixels on the basis of a detection result of luminance degradation detection, wherein detected luminances of light emitted by the second reference pixels are used as a reference for approximating an initial state of the display pixels.

18. The display device of claim 17, further comprising:

driving the first reference pixels to emit light by applying thereto respective predetermined input signal voltages whenever the plurality of display pixels are driven to emit light.

19. The display device of claim 17, further comprising:

driving the second reference pixels to emit light only when performing luminance degradation detection.

* * * * *